US009616313B2

(12) United States Patent
Townsend

(10) Patent No.: US 9,616,313 B2
(45) Date of Patent: Apr. 11, 2017

(54) PORTABLE THERAPEUTIC STRETCHING AND MASSAGE STORAGE DEVICE

(71) Applicant: Dustin Townsend, San Diego, CA (US)

(72) Inventor: Dustin Townsend, San Diego, CA (US)

(73) Assignee: Canyon Hard Goods LLC, San Diego, CA (US)

( * ) Notice: Subject to any disclaimer, the term of this patent is extended or adjusted under 35 U.S.C. 154(b) by 286 days.

(21) Appl. No.: 14/329,653

(22) Filed: Jul. 11, 2014

(65) Prior Publication Data

US 2016/0008692 A1 Jan. 14, 2016

(51) Int. Cl.

| | |
|---|---|
| ***B65D 43/00*** | (2006.01) |
| ***A63B 71/00*** | (2006.01) |
| ***A45C 13/00*** | (2006.01) |
| ***A45C 13/12*** | (2006.01) |
| ***A45C 13/30*** | (2006.01) |

(Continued)

(52) U.S. Cl.

CPC ..... *A63B 71/0036* (2013.01); *A45C 9/00* (2013.01); *A45C 13/008* (2013.01); *A45C 13/123* (2013.01); *A45C 13/30* (2013.01); *A45C 15/00* (2013.01); *A61H 15/00* (2013.01); *B65D 11/02* (2013.01); *B65D 43/0206* (2013.01); *A45C 2009/007* (2013.01); *A61H 7/007* (2013.01); *A61H 2015/0014* (2013.01); *A61H 2201/0111* (2013.01); *A61H 2201/0115* (2013.01); *A61H 2201/0157* (2013.01); *A61H 2201/1253* (2013.01); *A61H 2201/1284* (2013.01); *A61H 2201/164* (2013.01); *A61H 2201/165* (2013.01); *A61H 2201/1614* (2013.01); *A61H 2201/1623* (2013.01); *A61H 2201/1695* (2013.01); *A63B 21/00069* (2013.01); *A63B 21/0442* (2013.01); *A63B 21/0552* (2013.01); *A63B 21/4037* (2015.10); *A63B 2023/006* (2013.01);

(Continued)

(58) Field of Classification Search

CPC .. A47J 41/0011; B65D 81/3876; B65D 11/02; B65D 43/0206; B65D 39/088; A63B 71/0036; A45C 15/00; A45C 9/00; A45C 13/30; A45C 13/008; A45C 13/123; A45C 2009/007

USPC ..... 206/315.1

See application file for complete search history.

(56) References Cited

U.S. PATENT DOCUMENTS 1,903,798 A * 4/1933 Turner ..... A01K 97/08 224/235
D111,794 S * 10/1938 Oswell ..... D7/635

(Continued)

FOREIGN PATENT DOCUMENTS

WO WO9012529 1/1990
WO 9012529 A1 11/1990

OTHER PUBLICATIONS

Faith Durand, Help Me Find Good Kitchen Cnisters, Jul. 14, 2011, http:// www.thekitchn.com.*

(Continued)

*Primary Examiner* — Anthony Stashick
*Assistant Examiner* — Ernesto Grano
(74) *Attorney, Agent, or Firm* — Procopio Cory Hargreaves and Savitch LLP

(57) ABSTRACT

Disclosed herein is a portable exercise storage apparatus, comprising: a rigid hollow tube comprising a first end and a second end; a first end cap that is configured to removably close the first end; and at least one strap releasably connected to the first end and the second end.

13 Claims, 3 Drawing Sheets

(51) Int. Cl.

| | |
|---|---|
| ***B65D 8/00*** | (2006.01) |
| ***B65D 43/02*** | (2006.01) |
| ***A45C 9/00*** | (2006.01) |
| ***A45C 15/00*** | (2006.01) |
| ***A61H 15/00*** | (2006.01) |
| *A63B 21/04* | (2006.01) |
| *A63B 21/055* | (2006.01) |
| *A63B 23/00* | (2006.01) |
| *A63B 21/00* | (2006.01) |
| *A61H 7/00* | (2006.01) |

(52) U.S. Cl.
CPC ... *A63B 2225/605* (2013.01); *A63B 2225/685* (2013.01); *A63B 2225/687* (2013.01)

(56) References Cited

U.S. PATENT DOCUMENTS 2,546,095 A 3/1951 Walter
2,595,230 A * 5/1952 Daviau ..... A01K 97/08 206/315.11
2,600,021 A * 6/1952 Pritchard ..... B67D 1/08 220/291
2,962,187 A * 11/1960 Morris ..... A01K 97/08 206/315.11
3,128,812 A * 4/1964 Scheurer ..... A63B 55/408 128/DIG. 15
3,263,806 A * 8/1966 Ring ..... B65D 81/3834 206/139
D271,162 S * 11/1983 Evans ..... D3/254
4,558,807 A * 12/1985 Jackson ..... A45B 25/24 224/251
D283,758 S * 5/1986 Stewart ..... 224/148.4
4,643,302 A 2/1987 Baumgardner
D291,842 S * 9/1987 Baumgardner ..... D3/254
4,726,469 A * 2/1988 Farber ..... A45C 11/12 206/301
D302,775 S * 8/1989 Sinoff ..... D3/202
4,961,497 A 10/1990 Sherer et al.
5,131,383 A 7/1992 Juarez
D329,895 S * 9/1992 Chumsae ..... D23/393
D334,689 S * 4/1993 Mason ..... D3/202
5,335,809 A * 8/1994 Toida ..... A47J 41/0011 220/23.88
5,417,327 A 5/1995 Saumure
5,425,194 A * 6/1995 Miller ..... A01K 97/08 206/315.11
5,554,102 A 9/1996 Chiou
5,588,953 A 12/1996 Chang
5,634,680 A 6/1997 Green
D391,755 S * 3/1998 Grimm ..... D3/11
5,824,013 A * 10/1998 Allen ..... A61F 5/01 128/845
5,927,535 A 7/1999 Goth
6,062,382 A * 5/2000 Czerkie ..... A01K 97/08 206/315.11
6,273,158 B1 8/2001 Sharpe
D476,151 S * 6/2003 Peterson ..... D3/221
D517,315 S * 3/2006 Amin ..... D3/273
D525,786 S * 8/2006 Orlando ..... D3/254
7,121,401 B1 * 10/2006 Sinha ..... F42B 39/02 206/3
8,029,425 B2 * 10/2011 Bronston ..... A63B 21/02 482/123
D688,042 S * 8/2013 King ..... D3/276
8,561,422 B2 * 10/2013 Jackman ..... F25D 3/08 62/457.2
8,925,724 B1 1/2015 Normand
8,985,330 B1 * 3/2015 Normand ..... B65D 85/72 206/427
8,991,600 B1 * 3/2015 Normand ..... B65D 85/72 206/427
D731,780 S * 6/2015 Mingo ..... D3/11
9,049,912 B1 * 6/2015 Normand ..... B65D 85/72
2005/0215928 A1 * 9/2005 Banks ..... A61H 15/0092 601/112
2006/0241537 A1 10/2006 Liu
2008/0070210 A1 * 3/2008 Hitzmann ..... A61H 15/00 434/237
2010/0320213 A1 * 12/2010 Kelly ..... A47J 41/0077 220/592.2
2012/0065557 A1 3/2012 Phillips
2012/0309599 A1 12/2012 Miller, Jr.

OTHER PUBLICATIONS

PR Admin, Ricoh patents an impact resistant lens cap, May 23, 2012, http:// www.photorumors.com.*
International Search Report, PCT/US2015/039256, Korean Intellectual Property Office, Oct. 5, 2015.
Search Report under Section 17 and Examination Opinion mailed Feb. 6, 2015 for related United Kingdom Patent Application No. GB1413958.8, filed Aug. 6, 2014, in 6 pages.
GB1413958.8, Search Report, Feb. 6, 2015.

* cited by examiner

PORTABLE THERAPEUTIC STRETCHING AND MASSAGE STORAGE DEVICE

FIELD OF THE INVENTION

The present apparatus is in the field of a portable therapeutic stretching and massage apparatus with storage capability.

BACKGROUND OF THE DISCLOSURE

In today's sport fitness and massage market place there are numerous equipment options for personal use. The massaging of muscles benefits the health of the muscle tissue due to improved blood circulation, and the release of waste material from the muscle and connective tissues. Moreover, stretching muscles and connective tissue prior to any physical activity provides the benefit of warming up said muscles and connective tissue in order to prevent injury. There are numerous devices known in the art for massaging muscles or other tissues. However, there are no known devices that combine the personal storage and stretching and massage functions of the present apparatus.

SUMMARY OF THE INVENTION

Disclosed herein is a portable exercise storage apparatus, comprising: a rigid hollow tube comprising a first end and a second end; a first end cap that is configured to removably close the first end; and at least one strap releasably connected to the first end and the second end.

BRIEF DESCRIPTION OF THE DRAWINGS

FIG. 4 is an illustration of an embodiment of attaching a strap to the disclosed portable exercise storage apparatus.

DETAILED DESCRIPTION OF THE EMBODIMENTS

Figure 1:
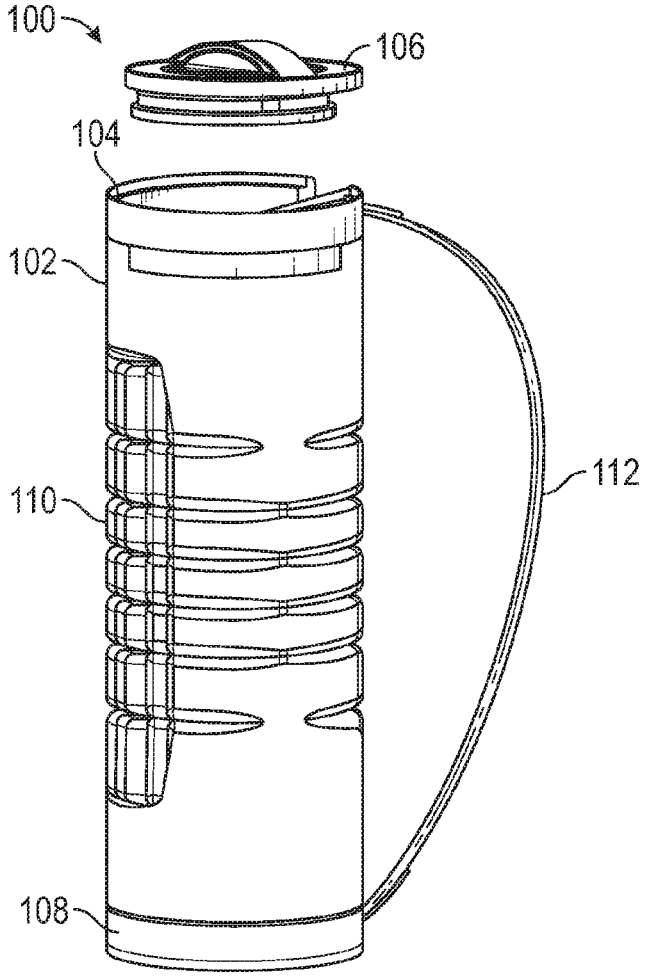
FIG. 1 is an illustration of an embodiment of the disclosed portable exercise storage apparatus.

The following is a detailed description of certain specific embodiments of the apparatus disclosed herein. In this aspect, the present disclosure pertains to a portable therapeutic stretching, massage, and storage device. Reference is made to the accompanying drawings, which represent certain aspects of the apparatus. In the drawings, similar numerals typically identify similar components, unless context dictates otherwise. The illustrative embodiments described in the detailed description, drawings, and claims are not meant to be limiting.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

The apparatuses disclosed herein pertain to a cylindrical hollow tube for storing personal items, a yoga mat, etc., while having the functionality to be used for stretching muscles and connective tissue prior to any fitness routine and massaging muscles and connective tissue following physical activity. In this aspect, the present cylindrical apparatus provides for massage therapy by the user rollingly applying pressure against the massage bumps of the cylindrical massage pad with the result of relieving tightness, knots and soreness from muscles in a user's body. Therefore, with the use of the cylindrical massage pad a user may effectively and safely relieve muscle tension and pain.

The presently disclosed apparatuses further portable personal storage and stretching and massage functions in a single device. Furthermore, the massage pad component of the disclosed apparatuses comprise massage bumps intended to provide rolling massaging relief to muscles and connective tissue. The apparatuses conveniently comprise at least one strap for carrying the apparatus and when disconnected from the apparatus may be used for stretching and warming up muscles and connective tissue prior to any physical activity.

Thus, in one aspect, disclosed herein are portable exercise storage apparatuses, comprising:

a) a rigid hollow tube comprising a first end and a second end;

b) a first end cap that is configured to close the first end and a second end cap configured to close the second end; and c) at least one strap releasably connected to the first end and the second end. wherein an inner volume of the rigid hollow tube provides a storage area.

Referring now to the drawings, FIG. 1 shows an embodiment of a portable exercise storage apparatus 100 disclosed herein. The apparatus 100 comprises a rigid hollow tube 102, a first end 104, a first end cap 106, and a second end 108. In some embodiments, the apparatus 100 further comprises a strap 112. In some embodiments, the second end 108 is permanently closed. In other embodiments, the apparatus 100 further comprises a second end cap (not shown), where both the first end cap 106 and the second end cap are removable.

In some embodiments, a portion of the outer surface of the tube 102 comprises a plurality of raised flat ridges 110. When rolled against a body, the raised flat ridges 110 provide a further massaging benefit. In some embodiments, the outer circumference of the raised flat ridge 110 area is the same as the outer circumference of the rest of the tube 102. In other embodiments, the outer circumference of the raised flat ridge 110 area is greater than the outer circumference of the rest of the tube 102.

In the embodiment of FIG. 1, the first end cap 106 is shown in the open position. The strap 112 is attached to the first end 104 and the second end 108, respectively, as described in more detail below. In some embodiments, the strap provides a resistance to the user when the user is stretching. In these embodiments, a user can detach the strap from the apparatus 100 and use the strap to stretch muscles, ligaments and tendons. In some embodiments, the strap is used to carry the apparatus 100 when the strap is secured at both ends. In some embodiments, the strap further comprises an adjustable buckle or a strap retractor for adjusting the length of the strap.

In some embodiments, not shown, the interior of the tube 102 is divided into two compartments. The removal of the first end cap 106 provides access to the first compartment and the removal of the second end cap provides access to the second compartment. Thus, for example, the first compartment may be much larger than the second compartment. The user may store a rolled yoga mat or a rolled towel, etc., in the first compartment, and store keys, mobile phone, wallet, etc. in the second compartment.

In some embodiments, the length of the apparatus 100 is sized according to the width of a standard yoga mat, such that the apparatus 100 can accommodate the mat when rolled up.

Figure 2:
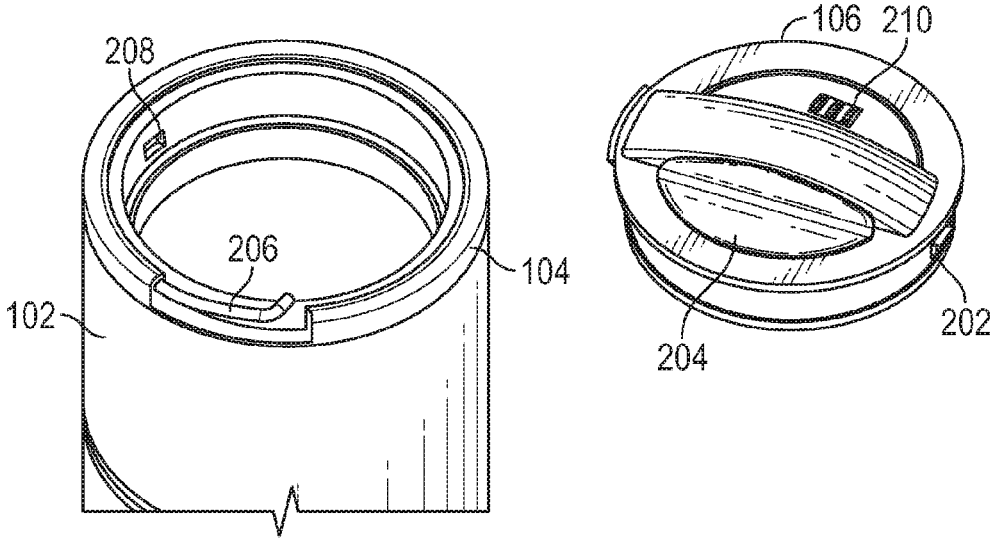
FIG. 2 shows an embodiment of a locking mechanism for an end cap of the disclosed portable exercise storage apparatus.

FIG. 2 illustrates some of the components of a locking mechanism for the first end cap 106. The first end cap 106 comprises at least one movable tongue 202. In some embodiments, the cap 106 comprises two or more tongues 202. In certain embodiments, the cap 106 comprises two tongues 202, located opposite each other around the perimeter of the cap 106. The first end 104 comprises corresponding grooves 208 on the interior perimeter thereof. When the first end cap 106 is placed over the first end 104 and is pushed in place, the tongue 202 clicks into the groove 208 and immobilizes the cap 106 in its closed position.

The tongue 202 is movably connected to a push button 204. When the button 204 is pushed in, the tongue 202 is retracted into the cap 106 and clears the groove 208. The end cap 106 now becomes clear to be removed from the tube 102. A spring mechanism then returns the button 204 to its resting ("out") position, and returns the tongue 202 to its resting extended position.

In some embodiments, a lock 210 is provided. In some of these embodiments, for example the one shown in FIGS. 2 and 3, the lock 210 is a combination lock. In other embodiments, the lock 210 is a keyed lock. When the lock 210 is engaged, the push button 204 is prevented from moving and the tongue 202 remains secure in its extended position. When the lock 210 is disengaged, the push button 204 can be moved. Locking mechanisms that can be used for the lock 210 are well-known in the art and skilled artisan knows how to incorporate the locking mechanism into the present apparatus.

A rod 206 is provided having the same curvature as the tube 102. The rod 206 traverses an arc of <180°, and preferably an arc of <90°, along the perimeter of the first end 104. As discussed below, the rod 206 is used in securing the strap 112 to the apparatus 100.

Figure 3:
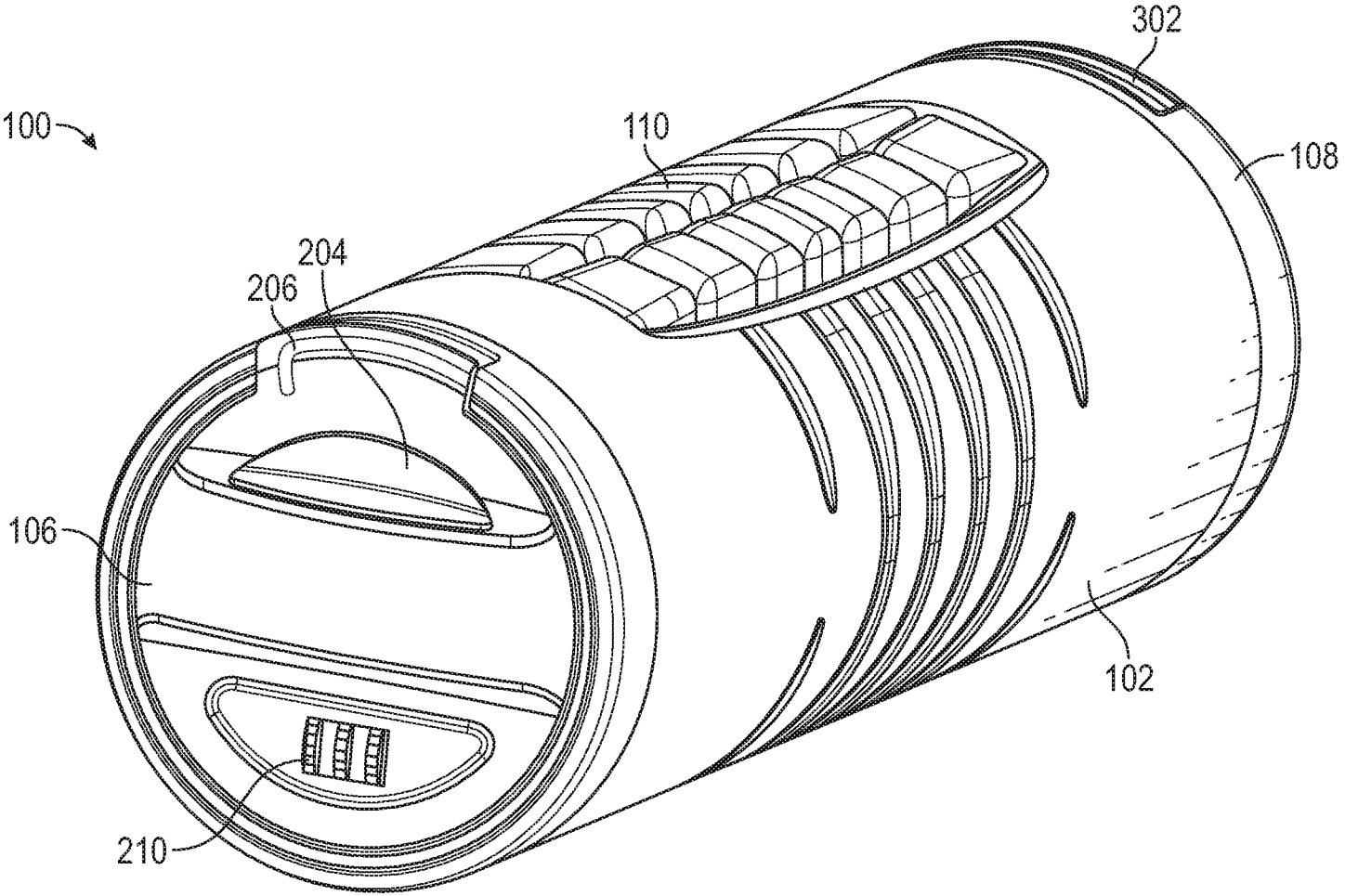
FIG. 3 is a perspective top view of an embodiment of the disclosed portable exercise storage apparatus, showing an embodiment of the locking mechanism.

FIG. 3 shows a top view of the apparatus 100 when the end cap 106 is in a secured and locked position over the first end 104.

In some embodiments the second end 108 also comprises a corresponding one or more grooves 208. In these embodiments, when the first end cap 106 is removed from the first end 104, the first end cap 106 can be secured to the second end 108 using the same mechanism as described above for securing the first end cap 106 to the first end 104. In these embodiments, the apparatus 100 can accommodate a rolled yoga mat, where the length of the mat is longer than the length of the apparatus 100. The first end cap 108 is secured to the second end 108 so that it remains with the apparatus 100 and does not get lost.

In some embodiments, the first end cap 106 makes a water tight seal, which results in the contents of the apparatus 100 remaining dry, when the apparatus 100 has become wet, or in some embodiments, when the apparatus 100 is dropped in water, for example in a pool. Furthermore, the water tight aspect of the apparatus 100 allows for the apparatus 100 to function as a floatation device.

Figure 4A:
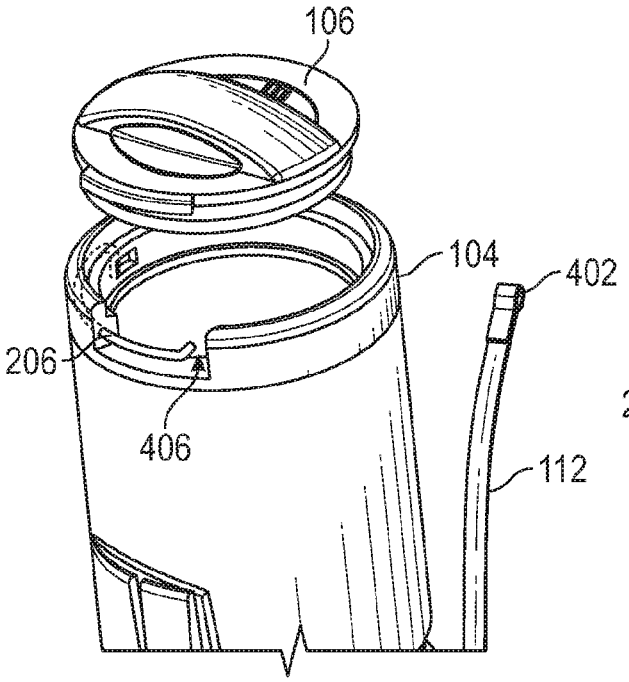
FIG. 4A shows the strap and the apparatus disconnected.

FIG. 4 shows the mechanism for attaching the strap 112 to the apparatus 100. The strap 112 comprises a loop 402 at one end and a loop 404 at another end. In some embodiments, the loops 402,404 are made by folding the end of the strap 112 onto itself and sewing or otherwise attaching the end to the strap, thereby creating a loop. In other embodiments, the loops 402,404 are rings or other closed objects that are attached to the ends of the strap 112, for example by sewing or gluing them on. In some embodiments, the loops 402,404 each independently comprises a connector selected from the group consisting of a swivel, carabineer, clip or hook.

Figure 4B:
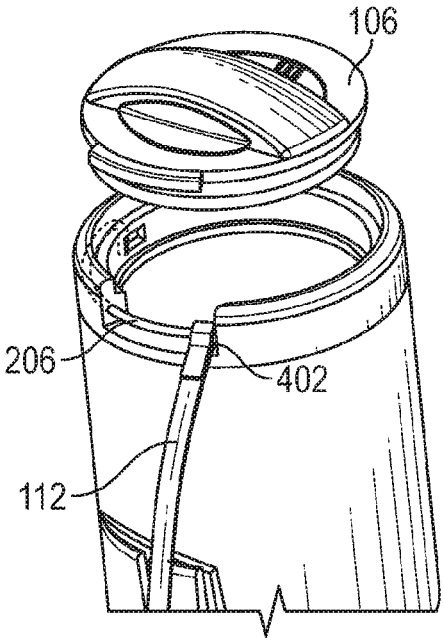
FIG. 4B shows the strap and the apparatus connected at the first end.

The strap 112 is attached to the apparatus 100 by using rods 206 and 302. As shown in FIGS. 2 and 4, while the rod 206 connects to the tube 102 at one end, it does not connect to the tube 102 at the other end. Instead, at the free end, rod 206 turns toward the interior of the tube 102. At this free end, a space 406 is created between the end of the rod 206 and the wall of the first end 104. The space 406 is large enough such that the loop 402 of the strap 112 can be threaded over the rod 206 (FIG. 4B). Doing so, attaches one end of the strap 112, i.e., the end with the loop 402, to the first end 104 of the tube 102.

Figure 4C:
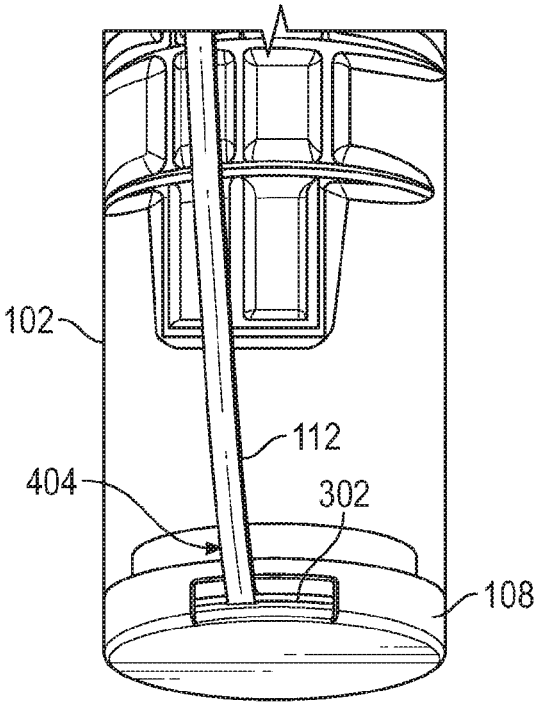
FIG. 4C shows the strap and the apparatus connected at the second end.

Rod 302 at the second end 108 is connected at both ends to the walls of the end 108. Thus, rod 302 does not have an open end. However, a space exists around the rod 302. The second end of the strap 112, i.e., the end with loop 404, is then threaded around the rod 302, as shown in FIG. 4C. The loop 404 is then brought back to the end 104 and is threaded over the rod 206, similar to the procedure for the loop 402. Thus, both loops 402 and 404 are now connected to the same rod 206 at the first end 104, while at approximately halfway point of the strap 112, it is threaded around rod 302 at the second end 108. When the cap 106 is placed over the end 104 and is secured in place, the space 406 is no longer open. Both loops 402 and 404 become securely attached to the rod 206.

At this point, the strap 112 is fully attached to the apparatus 100, which takes the form shown in FIG. 1. In these embodiments, the strap 112 is in two sections (one from the loop 402 to rod 302, the other from the rod 302 to loop 404). A user can put the user's hands through the sections of the strap 112 and wear the apparatus 100 as a backpack.

In some embodiments, the tube 102 is made from aluminum, plastic, PVC, propylene, rubber, foam, silicone, neoprene or combinations thereof.

In some embodiments, the strap 112 is made from polyester, propylene, nylon, cotton, rubber, silicone gel or combinations thereof.

In some embodiments, the raised flat ridges 110 are made from rubber, elastomeric foam, silicone gel or combinations thereof.

In some embodiments, the plurality of the raised flat ridges 110 are identical or variable in shape, size, density and firmness.

In some embodiments, the plurality of the raised flat ridges 110 further comprise a linearly arranged waffle pattern of variable sized contoured square or circular ridges.

What is claimed is:

1. A portable exercise storage apparatus, comprising:

a) a rigid hollow tube comprising a first end and a second end;

b) a first end cap that is configured to removably close the first end; and c) at least one strap releasably connected to the first end and the second end, wherein the first and second ends each further comprises a rod for securing the at least one strap, wherein the first end cap comprises a push button, a movable tongue movably connected to the push button, a central handle with the push button therein, and a combination lock that when engaged, prevents the push button from moving, and the combination lock is adjacent to the handle in the end cap.

2. The apparatus of claim 1, further comprising a second end cap to removably close the second end.

3. The apparatus of claim 1, wherein a portion of the outer surface of the tube comprises a plurality of raised flat ridges.

4. The apparatus of claim 3, wherein the outer circumference of the raised flat ridge area is the same as the outer circumference of the rest of the tube.

5. The apparatus of claim 1, wherein the at least one strap provides a resistance to a user when the user is stretching.

6. The apparatus of claim 1, wherein the first end cap makes a water tight seal with the first end.

7. The apparatus of claim 1, wherein the at least one strap comprises a first loop at a first end and a second loop at a second end.

8. The apparatus of claim 7, wherein the at least one strap when connected to the apparatus is configured to carry the apparatus and when disconnected from the apparatus is configured to be used to stretch muscles, ligaments and tendons.

9. The apparatus of claim 1, wherein the first end of the tube includes a perimeter with an arc and a curved rod along the perimeter of the arc, and the at least one strap is releasably connected to the curved rod along the perimeter of the arc at the first end of the tube.

10. The apparatus of claim 1, wherein the at least one strap is a strap with an intermediate section and loops at opposite ends that are attached to curved rod at the first end of the tube, and the tube includes a rod at the second end of the tube that the intermediate section of the strap is attached to whereby the strap allows one to wear the apparatus like a backpack.

11. The apparatus of claim 1, wherein the first end cap is removable from the first end and securable to the second end so that it remains with the apparatus and does not get lost.

12. A portable exercise storage apparatus, comprising:

a) a rigid hollow tube comprising a first end and a second end;

b) a first end cap that is configured to removably close the first end; and c) at least one strap releasably connected to the first end and the second end, wherein the at least one strap is a strap with loops at opposite ends, and the tube includes a peripheral segment with opposite ends adjacent to the first end of the tube, a curved rod connects to the tube at one end of the peripheral segment and terminates short of the opposite end of the peripheral segment forming a space, wherein when first end cap is removed from the first end of the tube, the space accommodates the loop of the strap to connect the loop to the curved rod and when the first end cap is secured to the first end of the tube, the space is blocked, securing the loop of the strap to the curved rod, preventing the loop of the strap from dislodging from the curved rod.

13. A portable exercise storage apparatus, comprising:

a) a rigid hollow tube comprising a first end and a second end;

b) a first end cap that is configured to removably close the first end; and c) at least one strap releasably connected to the first end and the second end, wherein the first and second ends each further comprises a rod for securing the at least one strap, wherein the first end cap is removable from the first end and securable to the second end so that it remains with the apparatus and does not get lost, the first end cap including a push button and a movable tongue movably connected to the push button, and the first end of the tube includes a groove that receives the movable tongue to immobilize the first end cap in a closed position when the first end cap is placed over the first end, and the second end of the tube includes a groove that receives the movable tongue to immobilize the first end cap in a closed position when the first end cap is placed over the second end.

* * * * *